US005112656A

United States Patent [19]

Nakamura et al.

[11] Patent Number: 5,112,656

[45] Date of Patent: May 12, 1992

[54] COATING METHOD SUITABLE FOR USE IN PRODUCTION OF PHOTOSENSITIVE MEMBER FOR ELECTROPHOTOGRAPHY

[75] Inventors: Kazushige Nakamura, Yokohama; Mitsuru Honda, Tokyo; Hitoshi Toma, Kawasaki; Shigemori Tanaka, Tokyo; Keiichi Murai, Kashiwa; Akira Unno, Yokohama; Ako Takemura, Tokyo, all of Japan

[73] Assignee: Canon Kabushiki Kaisha, Tokyo, Japan

[21] Appl. No.: 255,486

[22] Filed: Oct. 11, 1988

[30] Foreign Application Priority Data

Oct. 15, 1987 [JP] Japan ..... 62-260857

[51] Int. Cl.[5] ..... B05D 1/02

[52] U.S. Cl. ..... 427/425; 427/421; 427/407.1; 427/419.2; 427/419.5; 239/591; 239/601; 239/596

[58] Field of Search ..... 427/407.1, 421, 419.2, 427/419.5, 425; 239/591, 601, 150, 596

[56] References Cited

U.S. PATENT DOCUMENTS

| | | | |
|---|---|---|---|
| 3,009,209 | 11/1961 | Weinbrenner et al. | 427/425 X |
| 3,318,725 | 5/1967 | Bryan | 427/421 X |
| 3,823,408 | 7/1974 | Gorden, III | 239/601 X |
| 3,849,128 | 11/1974 | Ihara | 96/1.5 |
| 3,953,626 | 4/1976 | Suzuki et al. | 427/425 X |
| 4,031,854 | 6/1977 | Sprague, Jr. | 118/302 X |
| 4,437,103 | 3/1984 | Ikeda | 239/601 X |
| 4,607,794 | 8/1986 | Horwood | 239/596 X |

FOREIGN PATENT DOCUMENTS

| | | |
|---|---|---|
| 649645 | 3/1935 | Fed. Rep. of Germany . |
| 1546968 | 12/1970 | Fed. Rep. of Germany . |
| 3602346 | 7/1987 | Fed. Rep. of Germany . |
| 1817428 | 10/1989 | Fed. Rep. of Germany . |
| 60-150053 | 8/1985 | Japan . |

OTHER PUBLICATIONS

Patent Abstracts of Japan, vol. 9, No. 3213 [P-414] (2046) Dec. 18, 1985.

*Primary Examiner*—Shrive Beck
*Assistant Examiner*—Alain Bashore
*Attorney, Agent, or Firm*—Fitzpatrick, Cella, Harper & Scinto

[57] ABSTRACT

A coating method is disclosed, wherein a substrate is coated with a paint discharged through an aperture in the form of not a spray but a continuous string. The coating method is suitably applied to a process for producing a photosensitive member for electrophotography, wherein a paint for providing the photosensitive member, such as the one for providing a photosensitive layer or intermediate layer, is discharged onto a rotating cylindrical substrate to be wound thereabout preferably like a thread on a spool, followed by leveling to form a coating film.

26 Claims, 8 Drawing Sheets

COATING METHOD SUITABLE FOR USE IN PRODUCTION OF PHOTOSENSITIVE MEMBER FOR ELECTROPHOTOGRAPHY

FIELD OF THE INVENTION AND RELATED ART

The present invention relates to a coating method which is simple and yet capable of providing an excellent coating film, and also a process for producing a photosensitive member for electrophotography by using such a coating method.

Hitherto, there have been known coating methods for providing a coating film on a substrate (a body having a surface to be coated) by using a paint, including the dip coating method wherein a substrate is dipped in a paint and gradually pulled up to form a coating film thereon by utilizing a surface tension acting between the substrate and the paint, and the roller coating method wherein a paint layer is once formed on a roller and then transferred onto the substrate to form a coating film. The dip coating method has an advantage that a coating film having a uniform thickness can be formed relatively easily but it requires a large amount of paint and a large apparatus depending on the shape and size of the substrate. Further, the dipped portion of the substrate is wholly coated including a part to be free of coating so that partial removal of the coating film is required to provide a low operation efficiency.

Further, in the roller coating method, the state of the resultant coating film depends on the distance between the roller and the substance, and the use thereof is restricted to application on a sheet, a can, etc., for which the distance can be easily controlled. Moreover, when the method is applied to a can, etc., a seam is formed on the coating film.

In addition to the above, a coating method called "spray coating method" is also known, in which a paint is discharged out of a nozzle having a minute aperture to be sprayed into minute droplets which are deposited on a substrate to form a coating film. According to the spray coating method, a coating film can be formed on substrates of various shapes and sizes in a wide area and a seamless coating can be formed on a can, etc. Thus, the spray coating method is a very effective method of forming a coating film.

The spray coating method, however, involves a problem that a volatile component in the paint evaporates while the paint is ejected owing to a pressure for spraying. Accordingly, the paint composition is liable to be changed and it is difficult to form a uniform coating film. Further, the paint is sprayed radially under the action of a pressure, etc., so that the application efficiency of the paint is low and additional equipment is required for ventilation to discharge the lost paint and for recovery, of the paint for preventing pollution. Further, when a coating film is formed on a substrate while moving a spray gun relative to the substrate, a coating defect is liable to be formed by deposition of a part of the paint on the already formed coating film. Further the sprayed paint is spread up to a portion which is not to be coated on the substrate so that removal of the excessive coating or protective means, etc., for preventing deposition of the paint, is required.

On the other hand, Japanese Laid-Open Pat. Appln. (Kokai) Sho. 52-119651 has proposed a method wherein a liquid-injection coater or a curtain coater is disposed in the proximity of a substrate, and the paint is supported between the substrate and the coater to form a film while avoiding the leakage of the paint. In such a coating method, however, the condition of the coating method depends on the supported state of the paint, so that the clearance between the substrate and the liquid-injection coater or curtain coater must be accurately controlled, and the precision of the substrate and the coater must be maintained to a high degree, thus resulting in a substantial increase in, operation cost. Further, the paint is still liable to leak through the clearance between the substrate and the coater so that it is extremely difficult to maintain the film forming conditions.

SUMMARY OF THE INVENTION

An object of the present invention is to provide a coating method capable of forming a coating film which is free of defects and is excellent in surface state and uniformity of material and thickness, and also a process for producing a photosensitive member for electrophotography utilizing the coating method.

Another object of the present invention is to provide a coating method which is simple, not requiring an apparatus of a large size and yet provides a good coating efficiency so as to remove the necessity of a ventilation equipment for removal of scattered paint and dust collection, and also a process for producing a photosensitive member for electrophotography using the coating method.

A further object of the present invention is to provide a process for producing a photosensitive member for electrophotography, which is excellent in potential uniformity.

According to the present invention, there is provided a coating method, comprising: discharging a paint through an aperture onto a substrate to coat the substrate with the discharged paint, wherein the paint is discharged from the aperture in the form of a continuous string substantially free from spraying. According to another aspect of the present invention, there is provided a process for producing a photosensitive member for electrophotography, comprising:

discharging a paint for providing a photosensitive member through an aperture onto a cylindrical substrate to coat the substrate with the discharged paint, wherein the paint is discharged from the aperture in the form of a continuous string substantially free from spraying.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
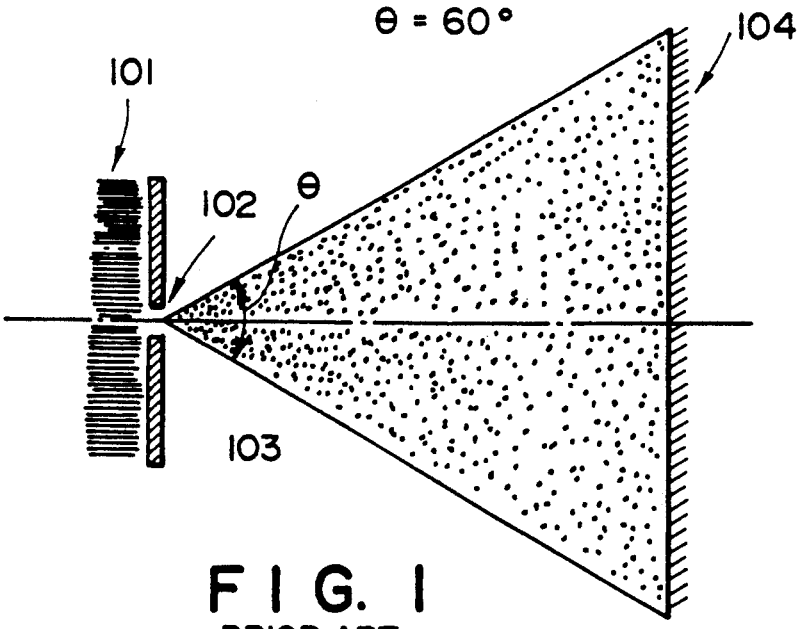
FIG. 1 PRIOR ART
FIG. 1 is an illustration of coating film formation by a conventional spraying method.

The conventional coating methods of discharging a paint through an aperture or minute opening to form a coating film, include (i) the air spraying method wherein the paint is discharged to be sprayed into fine liquid droplets under the action of a negative pressure caused by discharge of a pressurized air and wherein the liquid droplets are deposited on a substrate; and (ii) the air-less spraying method wherein a pressurized paint is discharged to be sprayed into fine liquid droplets, which are then deposited on the substrate. Referring to FIG. 1, in such a coating method, a paint 101 is discharged through a discharge port 102 at a discharge angle $\theta$, which is the largest angle formed by the sprayed paint, set to a large value of about 30–90 degrees so as to provide a uniform distribution of the sprayed paint 103 to form a uniform coating film 104, and at a high pressure to provide a high discharge velocity of 100–200 m/sec so as to stably communicate the sprayed particles. As a result, in a conical region from the discharge port up to the coating film where the sprayed paint is present, the paint occupies only a very small spatial proportion of 0.1%–0.001%. In other words, in the coating methods such as the air spraying method or the air-less spraying method where a paint is discharged through an aperture, the paint is extensively exposed to air.

A paint is generally diluted with a volatile component such as thinner, and such a volatile component is significantly vaporated to cause a denaturation of the paint as represented by an increase in solid content in the paint when the paint is extensively exposed to air. As a result, the resultant film exhibits irregularities, such as occurrence of spots, surface roughening and thickness irregularities. In an extreme case there occurs so-called "fiberization" wherein the paint is not sprayed but is solidified in the form of fiber in the neighborhood of the discharge port. In such a case, it is impossible to form a smooth and uniform coating film.

Further, as the discharge angle is large and the paint is present at a concentration as low as about 0.1%–0.001% in a large distribution region which is liable to be perturbed, it is difficult to define the border of a coating film edge at a desired part, and the paint is spread over to a part which is not to be coated. Therefore, it is necessary to cover such a part with a mask or cover so that the paint does not attach to the part. This results in a very troublesome operation.

Figure 2:
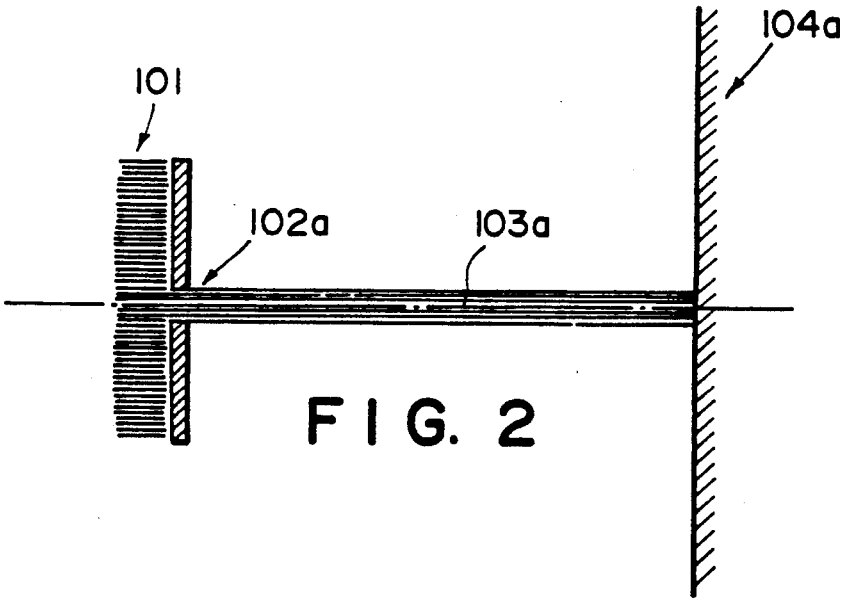
FIG. 2 is an illustration of the coating method according to the present invention.

In the present invention, in order to improve the film forming characteristic of a paint, the paint 103*a* discharged out of a discharge port 102*a* is not sprayed but is caused to be propelled in the form a string to from a coating film 104*a* as shown in FIG. 2, whereby the paint 103*a* is caused to occupy a larger spatial or volumetric proportion in the region of presence thereof to minimize the contact thereof with air and the denaturation thereof as by evaporation of a volatile component in the paint.

According to a principal characteristic of the present invention, it is preferred that the spatial proportion of the discharged paint is 100%, that is, the paint is not sprayed but reaches a substrate in the form of a string. It is however possible to obtain a similar effect through a very low degree of spraying forming a small discharge angle of 3 degrees or less which provides a spatial proportion of 95% to nearly 100% which is still much higher than the spatial proportion of 0.1%–0.001% given by the conventional spray coating method. Thus, the evaporation of a volatile component in the paint can be minimized to substantially obviate the denaturation of the paint.

Accordingly, in the coating method according to the present invention, by the term "substantially free of "spraying" is meant a state that the discharged paint is continuously propelled to reach a substrate while providing a discharge angle of 3 degrees or below, preferably 0 degree.

In the conventional coating method, the resultant coating efficiency has been as low as 20%–50% which loses 50%–80% of the paint used, whereas the coating efficiency achieved by the present invention is increased to 95% or higher because the paint is not substantially sprayed but is substantially confined in a desired coating region to substantially obviate attachment of the paint to a part not to be coated.

On the other hand, as the paint is incrementally adhered a minute region constituting a desired coating region, the energy of the paint impacting the substrate has a high density of ejection energy which is liable to roughen the resultant coating film. Therefore, a high discharge velocity as exercised in the conventional spraying method on the order of 100–200 m/sec is liable to provide ill effects to the coating film. In an extreme case, a coating defect such as bubbles results in the coating film. For this reason, in order to provide a coating film with a good surface state, it is preferred to use a discharge velocity of 30 m/sec or less, further preferably 2–25 m/sec, most preferably 5–10 m/sec, in view of the concentrative application of a paint onto a minute are (about 1/100 as compared with that in the conventional spraying method after taking into account some degree of spreading of the paint on the substrate).

The low discharge velocity of 30 m/sec or less gives a small energy to the paint attaching to the substrate so that all the paint is attached to the substrate without causing reflective scattering. As a result, it is possible to remarkably reduce an over-mist treatment and avoid the attachment of the paint to the non-coating area. Such an over-mist treatment has been extensively exercised by installing exhaust equipment for discharging the non-attached misty paint or from the system because such misty paint causes irregularities such as spots, splash and loss of gloss on the coating film. Further, it has been required to recover the mist by means of a dust collector, etc.

In the coating method according to the present invention, the distance between the substrate and the minute aperture constituting the discharge port may preferably be in the range of 2–100 mm, particularly 5–50 mm. A wide variety of paints may be used, including one comprising a solid matter dissolved or dispersed in a solvent or a molten solid matter free of a solvent. The solvent may include a volatile one as a matter of course and also a non-volatile one. The paint may preferably have a viscosity of 1000 cps (centi-poise) or below, further preferably 200 cps or below, most preferably 4–50 cps, so that the paint becomes smooth under the action of a surface tension after it is attached to the substrate.

The discharge port comprising a minute aperture may preferably have a diameter of 200 microns or less, more preferably 50–180 microns, most preferably 60–150 microns.

The paint may preferably be discharged through the aperture at a discharge pressure of 3 kg.f/cm$^2$ or below, more preferably 0.3–1.5 kg.f/cm$^2$, most preferably 0.5–1.0 kg.f/cm$^2$.

The paint may preferably be discharged at a rate of 20 cc/min or below, particularly 0.8–15 cc/min.

Incidentally, in the coating method of Japanese Laid Open Pat. Appln. (Kokai) Sho. 52-119651, the paint is held between the substrate and the liquid-injection coater or curtain coater under the action of a surface tension, and the condition of the resultant coating film depends on the arrangement of the substrate and the coater. According to the present invention, however, the dependence on the arrangement of the substrate and the discharge port is removed by causing the paint to fly or jump. As a result, the resultant state of the coating film is stabilized very much as compared with that in the above-mentioned coating method.

The coating method of the invention may be applicable to various fields.

According to the conventional method, for example, the coating of a large-sized substrate or a building has required a serious counter-measure to the over-mist problem, such as provision of a strict protection cover for preventing the substrate or building from being soiled with the over-mist. According to the present invention, however, the paint is substantially completely attached to the substrate, so that the coating may be effected very conveniently.

Further, in the conventional decorative field wherein paints of different colors (e.g., red, blue and green) are sprayed through the respective discharge ports under independent controls to cause color mixing, the paints are discharged at wide angles so that the paints are spread unintentionally to cause color mixing beyond an expected region of color mixing, thus resulting in decreases in saturation and clarity. The over-mist further lowers the saturation and clarity. According to the present invention, however, the paint is concentratively attached to a minute region without substantial scattering, so that color mixing is well controlled to provide remarkable improvements in saturation, clarity and resolution of the resultant coating.

The coating method of the present invention is also very effectively applicable to formation of thin films constituting, e.g., a photosensitive layer and an intermediate layer of a photosensitive member for electrophotography which requires a precise coating technique. Such films must be formed uniformly and evenly in a thickness on the order of several microns. This is particularly suitably accomplished by the coating method of the present invention which is characterized by no denaturation of the paint, excellent attachment or utilization of the paint and freeness from over-misting.

According to the process of the present invention for producing a photosensitive member for electrophotography, a coating paint for providing the photosensitive member is caused to continuously fly in the form of a string without substantial spraying to coat a cylindrical substrate.

The paint for providing the photosensitive member may include a paint for providing a photosensitive layer which in turn may include a charge generation and a charge-transport layer, and a paint for providing an intermediate layer which in turn may include a primer layer for enhancing adhesiveness and barrier characteristic and also an electroconductive layer covering the substrate. Such an electroconductive layer may suitably be disposed on a metal cylinder for preventing occurrence of a local cell and masking some defects on the cylinder.

The paint for providing the charge-generation layer may comprise, for example, a liquid dispersion of a charge-generating substance, such as azo pigment, quinone pigment, mono-cyanine pigment, perylene pigment, indigo pigment and phthalocyanine pigment, dispersed in a mixture of a binder resin, such as polyvinyl butyral, polystyrene, acrylic resin, polyester, polyvinyl acetate, and polycarbonate, and an organic solvent, such as alcohol, ketone, ether, aliphatic halogenated hydrocarbon and aromatic solvents.

The paint for the charge-transport layer may comprise, for example, a solution of a charge-transport substance, such as styryl compound, hydrazone compound, carbazole compound, pyrazoline compound, benzidine compound, and triarylmethane compound, and a binder resin, such as polyarylate, polystyrene, acrylic resin, polyester and polycarbonate, dissolved is an organic solvent as described above.

The paint for the primer layer may comprise, for example, a solution of a resin, such as casein, polyvinyl alcohol, and polyamide in an organic solvent as described above.

The paint for the electroconductive layer may comprise, for example, a liquid dispersion of conductive particles, such as those of titanium oxide, tin oxide, and carbon black, dispersed in a mixture of an appropriate resin, such as epoxy resin, phenolic resin, and polyurethane resin, and an organic solvent as described above.

The respective paints can contain an additive such as a lubricant, an antioxidant, a leveling agent etc.

The cylindrical substrate may be composed of, for example, aluminum, aluminum alloy, or stainless steel.

Other coating conditions for preparing the photosensitive member inclusive of the physical conditions of the paints and the operation are substantially the same as described hereinbefore.

Figure 3:
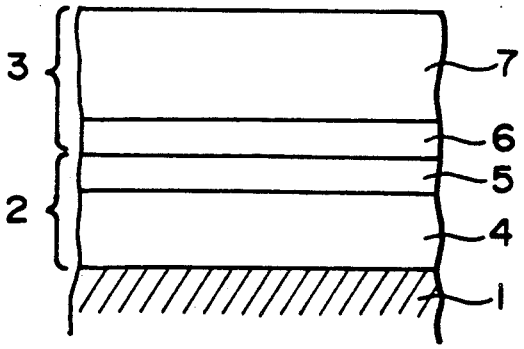
FIG. 3 is a schematic view for illustrating a laminar structure of a photosensitive member for electrophotography.

A photosensitive member for electrophotography having a laminar structure, for example, as shown in FIG. 3 may be produced by the process of the present invention by using these paints for providing a photosensitive member. Referring to FIG. 3, the photosensitive member comprises a substrate 1, and an intermediate layer 2 and a photosensitive layer 3 disposed in this order on the substrate 1. More specifically, the intermediate layer 2 includes an electroconductive layer 4 and a primer layer 5 in laminated form. The photosensitive layer 3 includes a charge-generation layer and a charge-transport layer in laminated form. The conductive layer 4 may preferably have a thickness of 5–30 microns; the primer layer 5, 0.1–5 microns; the charge-generation layer 6, 0.01–3 microns; and the charge-transport layer 7, 10–30 microns.

The coating method according to the present invention may be most suitably applied to formation of all of the conductive layer 4, the primer layer 5, the charge-generation layer 6 and the charge-transport layer 7. It is however possible to form one or two of these layers by another coating method, such as the dip coating method. Further, the conductive layer 4 and/or the primer layer 4 can be omitted from the photosensitive member. It is also possible to form the photosensitive member 3 by disposing the charge-generation layer 6 on the charge-transport layer 7 or to form the photosensitive member 3 in a single layer instead of a laminated structure as shown in FIG. 3.

Figure 4A:
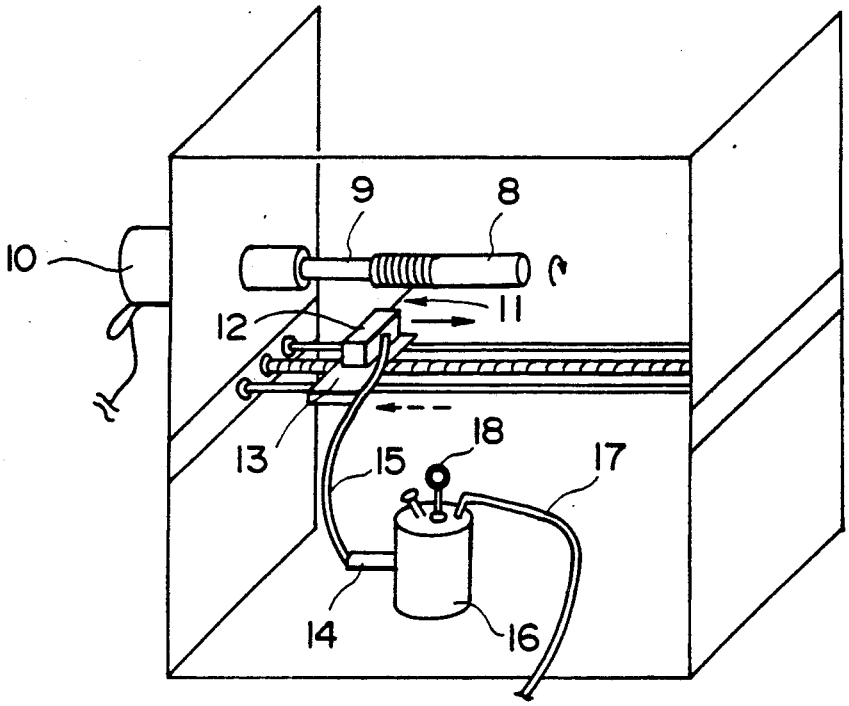
FIG. 4A is a perspective view of an apparatus for coating a cylinder surface.

FIG. 4A shows an embodiment of a coating apparatus for coating a cylindrical substrate such as that of a photosensitive member for electrophotography according to the coating method of the present invention.

Referring to FIG. 4A, a cylindrical substrate 8 is fixedly held by a rotating shaft 9, which is rotated at a prescribed rotational speed by a motor 10. A gun 12 for discharging a paint or coating liquid 11 in the form of a string or beam is loaded on a mount 13 provided with a laterally moving mechanism and moved in parallel with the longitudinal direction of the cylindrical substrate 8. The gun 12 is further connected to a paint tank 16 by the medium of a filter 14 and a withdrawal pipe 15. The paint in the tank is pressurized by compressed air introduced through an air pipe 17 to a prescribed pressure measured by a gauge 18 and discharged from a nozzle tip (not shown) of the gun 12 after passing through the filter 14 and the withdrawal pipe 15.

Figure 4B:
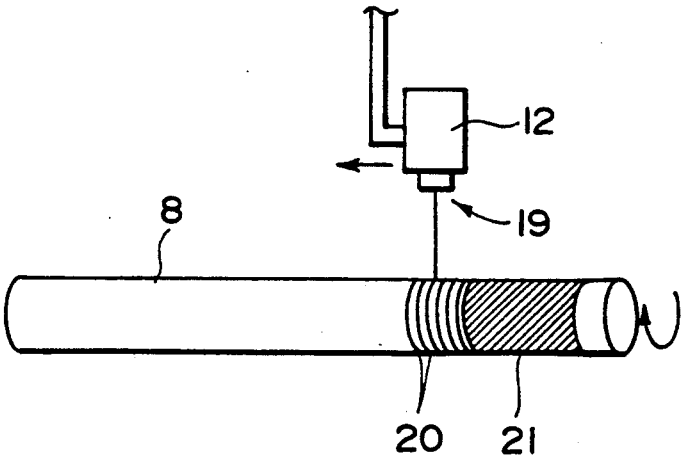
FIG. 4B is a partial enlarged view thereof.
Figure 4C:
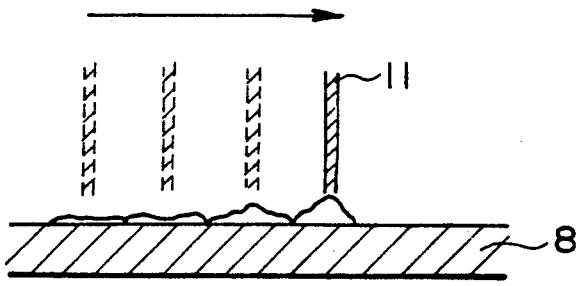
FIGS. 4C and 4D are illustrations of coating steps using the apparatus.

In an actual coating operation by using the apparatus, the switch of the laterally moving mechanism for the gun and the air switch for the gun needle are turned on, a paint beam 11 is discharged to a prescribed part of the cylindrical substrate. Simultaneously therewith, the rotational motor is turned on the rotate the shaft 9 holding the cylindrical substrate 8. As shown in FIG. 4B which is an enlarged view of a part around the substrate shown in FIG. 4A as viewed in a different direction, the paint beam 11 discharged from a nozzle tip 19 disposed at the tip of the gun 12 is wound about the cylinder 8 like a thread on a spool or spirally (with or without spacing between adjacent lines), to form a paint pattern 20 like a screw or solid coating pattern. The paint pattern 20 is then leveled to form a coating film 21. The leveling is effected as follows.

Figure 4D:
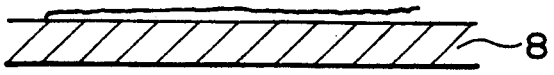

The paint pattern 20 attached to the cylindrical substrate 8 is gradually spread in width under the action of an impinging energy of the paint and a surface tension acting between the paint and the substrate, until the neighboring paint lines contact each other to cover the coated surface of the substrate while leaving no spacing therebetween. Further, in an appropriate period of time, the original unevenness pattern of the paint formed on the substrate depending on the coating pitch or speed is gradually leveled under the action of the diffusion force of the paint and the surface tension acting between the paint and the substrate, to finally provide a smooth surface as shown in FIG. 4D. The leveling can be promoted by using a hood for controlling the vaporization of the solvent in the paint to provide a smoother surface.

The pitch of the screw-like paint lines found by the paint beam on the substrate cylinder is determined by the rotational speed of the cylinder and the feeding speed of the gun. Further, the coating amount of the paint on a unit area is governed by the feeding speed if the discharge rate of the paint is constant. Thus, the following relationship holds.

$$\Delta Vu \propto P \cdot d/(v \cdot \lambda),$$

wherein $\Delta$Vu: discharge rate per unit area (cc/min.cm$^2$),

P: discharge pressure (kg.f/cm$^2$), d: discharge port or orifice diameter (cm), $\lambda$: length of a throat having a substantially constant diameter of the orifice (cm), v: feeding speed.

Further, with respect to the pitch of the paint lines, the following relationship holds:

$$Pw \propto v/Ro,$$

wherein

Pw: the pitch of paint lines (cm),

Ro: rotation speed of the cylinder (rpm).

Figure 5A:
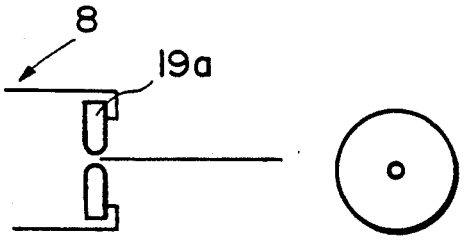
FIGS. 5A and 5B are respectively an illustration of an embodiment of a paint-discharge port.
Figure 5B:
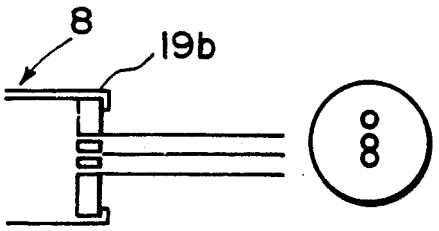

FIGS. 5A and 5B respectively illustrate an embodiment of the discharge port of the paint. In each figure, the right half is a front view and the left half is a side view. FIG. 5A shows a standard nozzle tip **19*a* having a simple discharge port, and FIG. 5B shows a nozzle tip 19*b*** having three discharge ports for accelerating the rate of the coating film formation.

Figure 14:
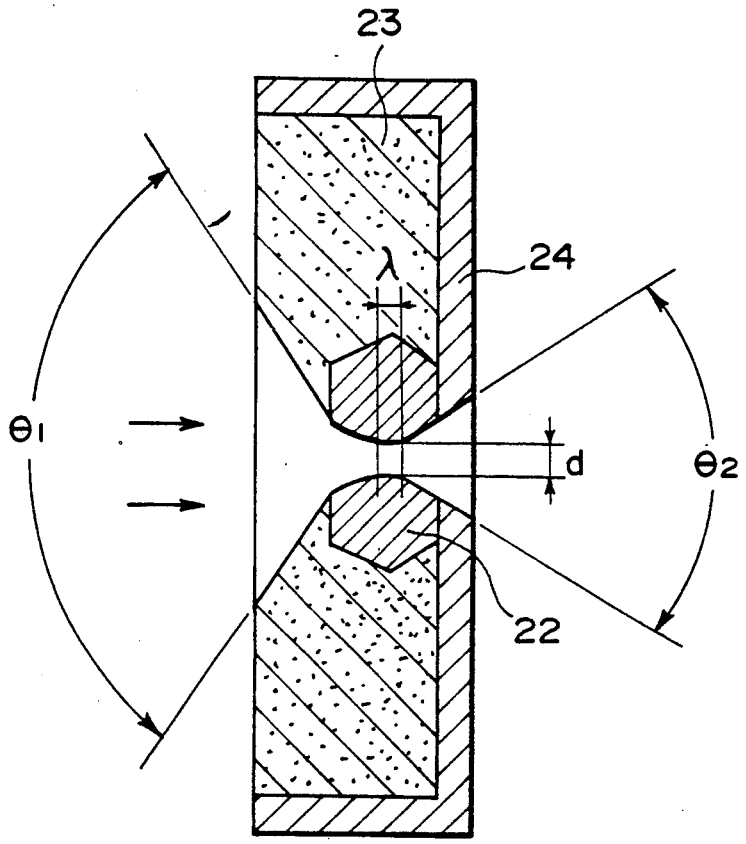
FIG. 14 is an enlarged sectional view of a nozzle tip having a paint discharge port suitable for the coating method of the present invention.

FIG. 14 is an enlarged sectional view of a nozzle tip having a discharge port particularly suited for the coating method of the present invention. The discharge port forms a choke angle $\theta_1$ on the inlet side, a divergent angle $\theta_2$ on the outlet side and a throat length $\lambda$ of a substantially constant throat or aperture diameter d. The discharge port is formed by a throat member 22 held by a fixing member 23 and a front cap 24. The angles $\theta_1$, and $\theta_2$ may preferably be in the range of 30–160 degrees. Particularly, the angle $\theta_2$ may preferably in the range of 120–160 degrees so as not to cause stagnation of the paint. It is however possible that the $\theta_2$ is 0 degree, i.e., has no divergence depending on property of the paint and the coating condition as far as the string-like discharge can effected. Too large a throat length $\lambda$ invites a large pressure loss, while to small $\lambda$ can lead to a poor durability. Accordingly, the $\lambda$ may preferably be in the range of 20–200 microns particularly 50–100 microns. The aperture diameter d may preferably be 200 microns or less, preferably 50–180 microns, particularly 60–150 microns. The shape of the aperture is most suitably a true circle but can be somewhat deformed therefrom inclusive of an oval or polygonal, for which the aperture diameter d can be defined as that of a true circle giving the same aperture area.

In a preferred embodiment, the throat member 22 may be formed of diamond crystal and held by a fixing member 23 of a metal alloy. Such a throat member of diamond crystal provides an extremely smooth and wear-resistant throat face so that the paint can pass very smoothly therethrough to be discharged very smoothly in the form of not a spray but a string in the coating method of the present invention.

In the coating method of the present invention, however, the discharge port can be formed in a simpler structure than that shown in FIG. 14, inclusive of a hollow cylinder having a bottom or covered with cap in which an aperture is bored, as far as it can provide a discharge in the form of not a spray but a string.

According to the coating method of the present invention, the following advantageous effects are obtained.

(1) A uniform coating film having a uniform thickness and a very small surface roughness is obtained.

(2) Little scattering or spraying of a paint is caused so that coating defects are not readily caused and a remarkable reduction in production cost can be attained.

(3) Because of little paint scattering, the coating is accomplished by an inexpensive apparatus without requiring a complicated apparatus for recovery of the misty paint.

(4) Because of little scattering, the coating can be conducted in an open space conveniently.

(5) Because of little scattering of the paint, soiling of a substrate is not substantially caused by spreading or scattering of the paint. As a result, no means for prevention of soiling such as masking is required and yet the coating is effected in a well controlled manner.

(6) When multi-color coating is effected by independently controlling paints of different colors, the coating of each color paint is well controlled to prevent unintentional mixing of the paints, whereby a color coating film with excellent saturation and clarity can be formed at a good resolution.

The present invention will now be explained more specifically based on Examples, where "parts" denote "parts by weight".

EXAMPLE 1

20 parts of polymethyl methacrylate resin (Mn (number-average molecular weight) $= 1 \times 10^4$) was dissolved in 80 parts of methyl ethyl ketone to prepare a paint having a viscosity of 50 cps.

The paint was pressurized to a discharge pressure of 1 kg.f/cm$^2$ and discharged through a nozzle tip having a single discharge port with an aperture diameter of 100 microns at a discharge velocity of 10.6 m/sec and a rate of 5 cc/min. in the form of not a spray but a string by using a coating apparatus as shown in FIG. 4A, whereby an aluminum cylinder having a diameter of 60 mm and a length of 240 mm was coated with the discharged paint with respect to its longitudinal portion ranging from 10 mm to 230 mm (coating breadth of 220 mm). In the coating operation, the cylinder was rotated at a speed of 100 rpm, and the discharge port was moved laterally at a rate of 200 mm/min (a coating pitch of 2 mm) relative to and with a spacing of 30 mm from the aluminum cylinder.

After the coating, the coated cylinder was dried at 100° C. for 10 minutes to form a coating film having an average thickness of 18 microns.

EXAMPLE 2

The coating operation in Example 1 was repeated except that a metal wire with a diameter of 10 microns was disposed at the center of the 100 microns-diameter aperture of the discharge port so as to provide a discharge angle of 3 degrees, whereby a coating film was formed in an average thickness of 18 microns.

Then, coating operations (Comparative Examples 1–4) were similarly conducted by disposing the 10 microns-diameter metal wire while controlling the longitudinal position thereof to obtain different discharge angles.

The results of the above coating operations are summarized in the following Table 1.

TABLE 1

| | Discharge angle (degrees) | Average thickness (μm) | Paint utilization (%) | Surface roughness of coating (μm) | Standard deviations of thickness (μm) | Fiberization |
|---|---|---|---|---|---|---|
| Example 1 | string | 18 | 100 | 0.1 | 0.2 | none |
| Example 2 | 3 | 18 | 97 | 0.1 | 0.2 | none |
| Comp. Example 1 | 15 | 16 | 65 | 0.17 | 0.3 | none |
| Comp. Example 2 | 20 | 10 | 55 | 0.23 | 0.5 | slightly observed |
| Comp. Example 3 | 40 | 6 | 35 | 0.40 | 0.7 | observed |
| Comp. Example 4 | 80 | 3 | 17 | 0.67 | 1.0 | observed |

The above results are also shown in FIGS. 6–9.

Figure 6:
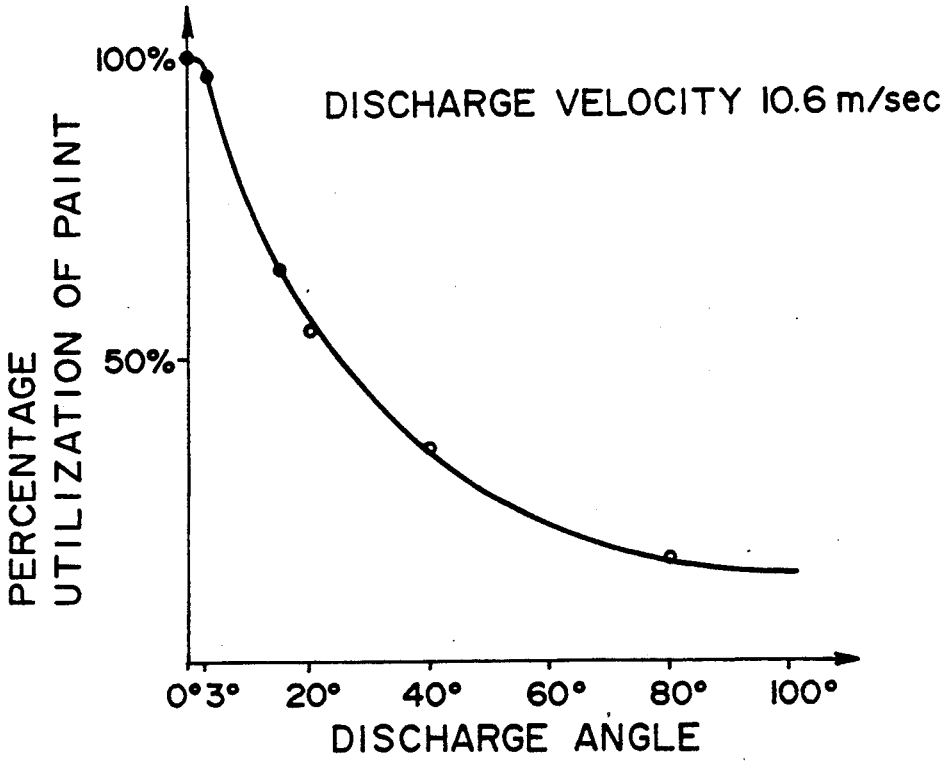
FIGS. 6 and 10 are graphs showing the dependence of percentage utilization of paint on a discharge angle and a discharge speed, respectively.
Figure 7:
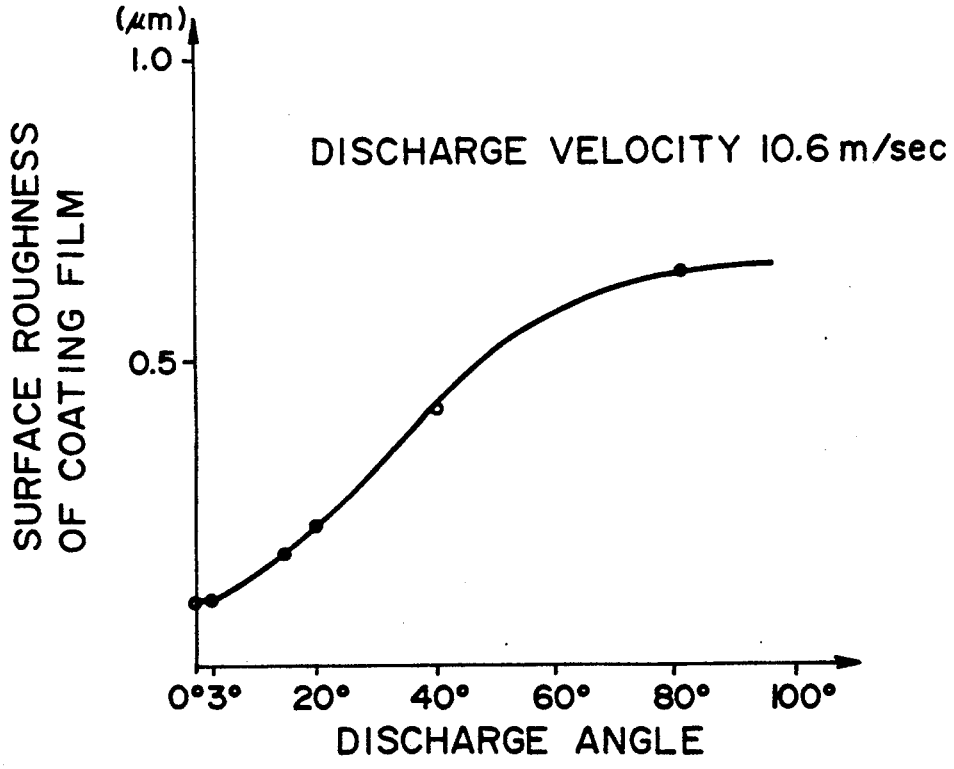
FIGS. 7 and 11 are graphs showing the dependence of a surface roughness of coating film on a discharge angle and a discharge speed, respectively.
Figure 8:
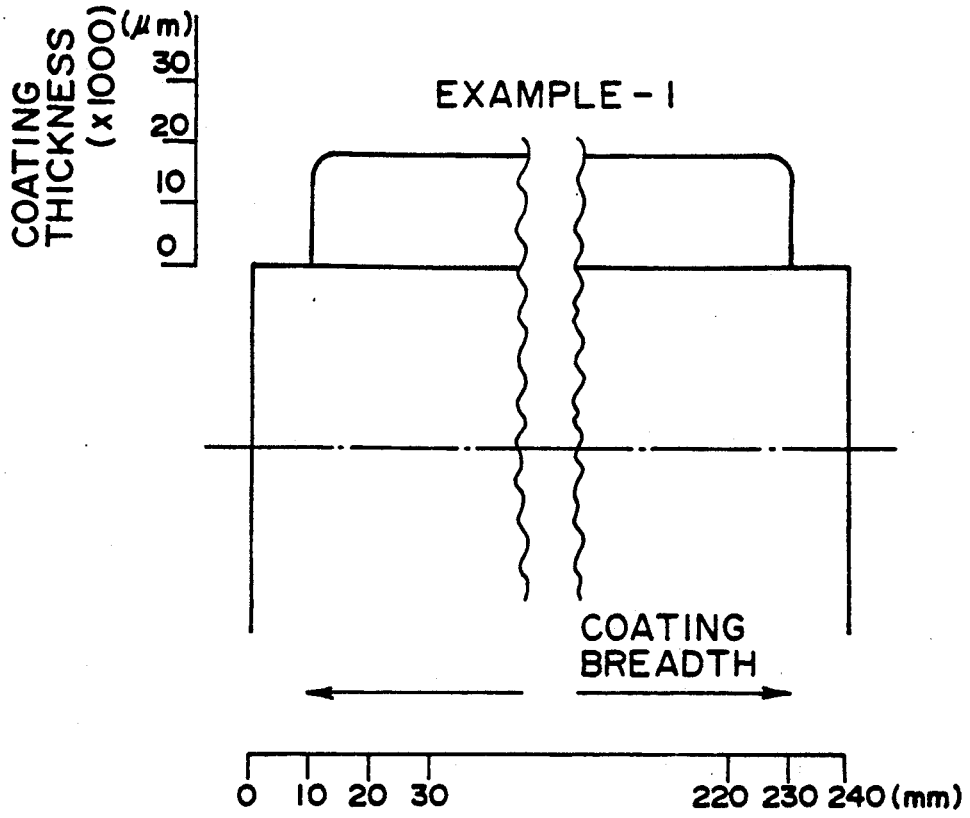
FIGS. 8 and 12 are schematic views showing coating thickness distributions obtained in Examples.
Figure 9:
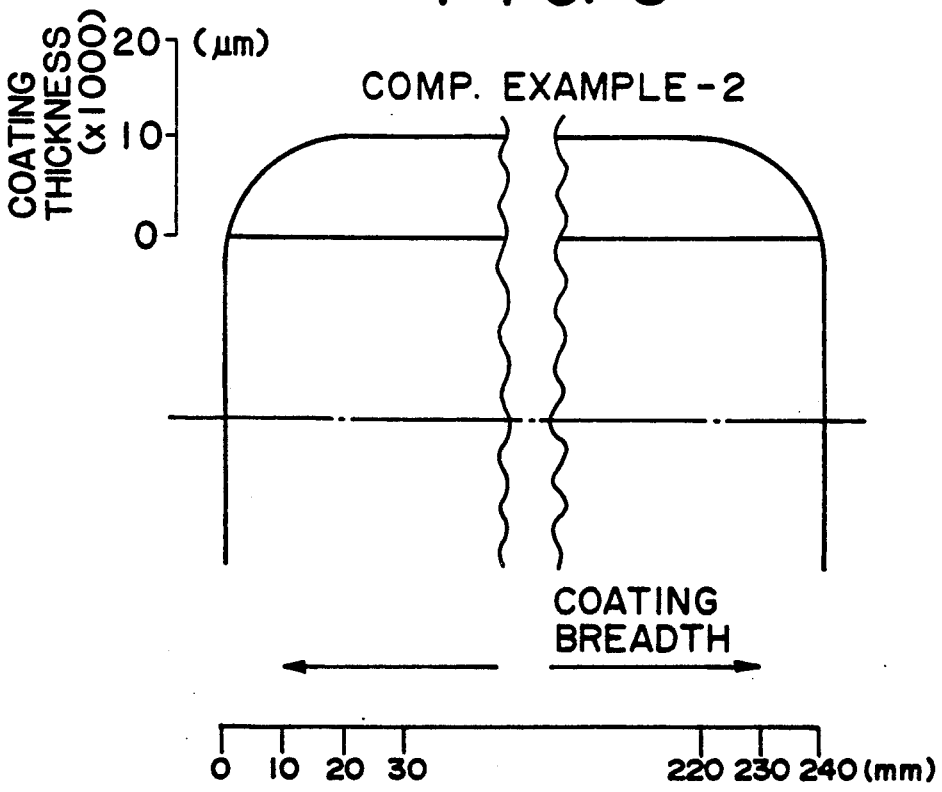
FIGS. 9 and 13 are schematic views showing coating thickness distributions obtained in the Comparative Examples.

More specifically, FIG. 6 shows a relationship between the percentage utilization of the paint and the discharge angle; FIG. 7 shows a relationship between the surface roughness of the coating film and the discharge angle; FIG. 8 is a schematic view illustrating the thickness distribution of the coating film of Example 1; FIG. 9 is a schematic view illustrating the thickness distribution of the coating film of Comparative Example 2. As the discharge angle was increased from substantially zero (a string form) to 80 degrees, the average film thickness was decreased from 18 to 3 microns as shown in the above Table 1, and the percentage utilization of the paint was decreased from 100% to 17% as shown in FIG. 6. Herein, the percentage utilization of paint refers to the percentage of the paint actually forming the coating film to the paint discharged from the discharge port.

The surface roughness of the coating film (ten point-average roughness (=average of roughness values measured at 10 points) along 2.5 mm—length of the cylinder) also increased from 0.1 to 0.67 micron as shown in FIG. 7.

The standard deviation of film thickness (when samples were taken and the thicknesses thereof were measured at pitch of 1 cm along the length of the cylinder) also increased from 0.2 to 1.0 micron as the discharge angle increased from 0 degree (string) to 80 degrees.

Further, the fiberization was increased in the order of Comparative Examples 1, 2, 3 and 4 to increase the defects on the coating films. Particularly, as shown in FIGS. 8 and 9 showing the coating thickness distribution, an excellent controllability of the coating film formation was achieved from the coating breadth of from 10 mm to 230 mm, outside which substantially no attachment of the paint occurred in Example 1.

On the other hand, in Comparative Examples operated at large discharge angles, the paint was also attached to outside the coating breadth region, thus resulting in a remarkable coating thickness charge in the breadth range of from 0 mm to 240 mm. Accordingly, in each Comparative Examples, masking or post-peeling of the excessively coated paint was necessary at both ends of the cylinder in order to control the coating breadth, thus requiring a complicated procedure for the coating.

EXAMPLE 3

20 parts of polymethyl methacrylate resin (Mn $=1\times10^4$) was dissolved in 80 parts of methyl ethyl ketone to prepare a paint having a viscosity of 50 cps.

The paint was pressurized to a discharge pressure of 0.5 kg.f/cm$^2$ and discharged through a nozzle tip having a single discharge port with an aperture diameter of 140 microns at a discharge velocity of 5.0 m/sec and a rate of 5 cc/min. in the form of not a spray but a string by using a coating apparatus as shown in FIG. 4A, whereby an aluminum cylinder having a diameter of 60 mm and a length of 240 mm was coated with the discharged paint with respect to its longitudinal portion ranging from 10 mm to 230 mm (coating breadth of 220 mm). In the coating operation, the cylinder was rotated at a speed of 100 rpm, and the discharge port was moved laterally at a rate of 200 mm/min relative to and with a spacing of 30 mm from the aluminum cylinder.

After the coating, the coated cylinder was dried at 100° C. for 10 minutes to form a coating film having an average thickness of 18 micron.

EXAMPLES 4, 5, COMPARATIVE EXAMPLES 5, 6, 7

The above coating operations of Example 3 was repeated except for the modifications of the discharge conditions as shown in the following Table 2. In each of the Comparative Examples, the discharge angle was 8 degrees. The results are also shown in Table 2.

TABLE 2

| | Discharge velocity (m/sec) | Discharge pressure (kg · f/cm$^2$) | Discharge aperture dia. (μm) | Average thickness (μm) | Paint utilization (%) | Surface roughness (μm) | Standard deviation of thickness (μm) | Number of bubbles in the coating film (-/100 cm$^2$) |
|---|---|---|---|---|---|---|---|---|
| Example 3 | 5.0 | 0.5 | 140 | 18 | 100 | 0.1 | 0.2 | 0 |
| Example 4 | 10.6 | 1.0 | 100 | 18 | 100 | 0.1 | 0.2 | 0 |
| Example 5 | 30.0 | 3.0 | 60 | 16.5 | 92 | 0.1 | 0.2 | 0 |
| Comp. Example 5 | 40.0 | 4.0 | 50 | 16 | 87 | 0.12 | 0.5 | 5 |
| Comp. Example 6 | 60.0 | 6.0 | 42 | 14.0 | 74 | 0.21 | 0.7 | 10 |
| Comp. Example 7 | 100.0 | 10 | 32 | 10.0 | 50 | 0.48 | 1.0 | 20 |

The above results are also shown in FIGS. 10–13.

Figure 10:
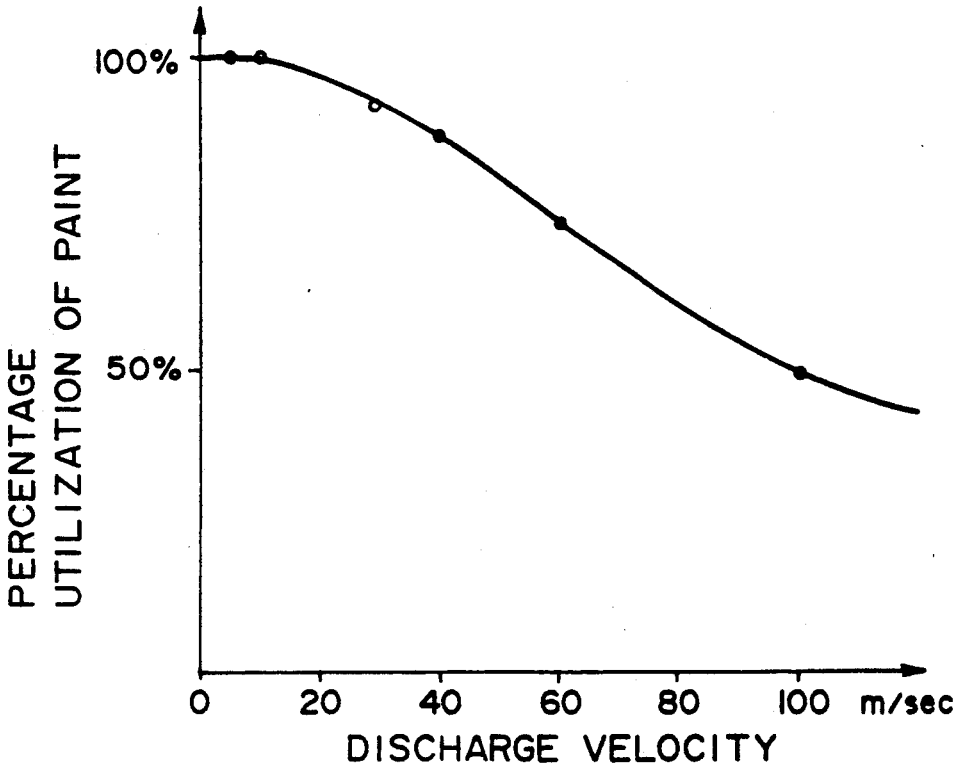
Figure 11:
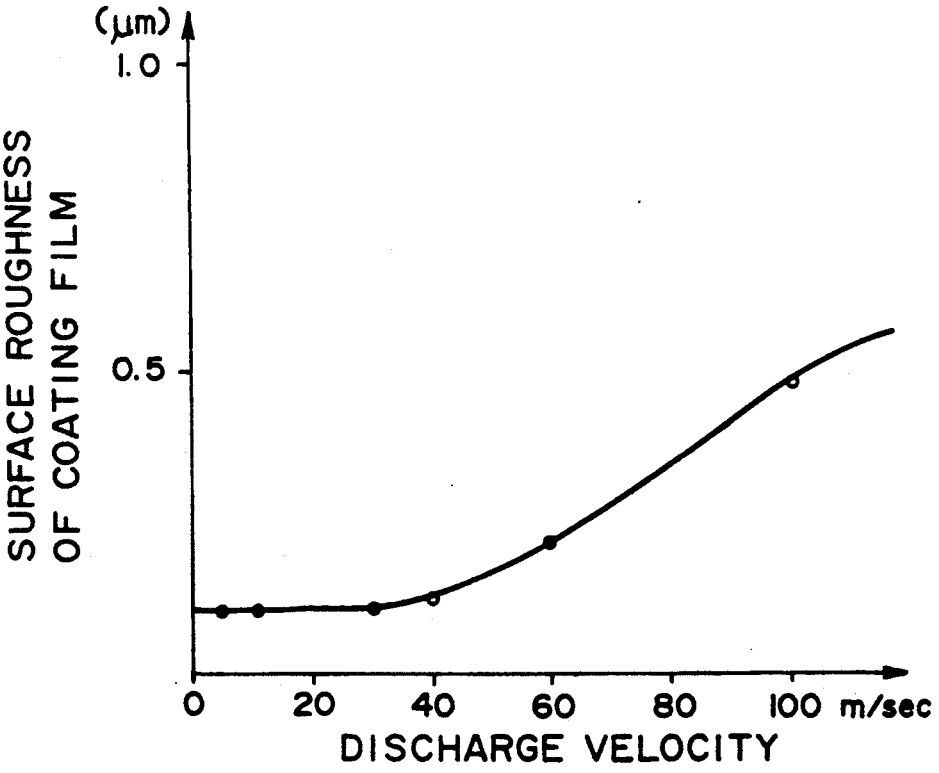
Figure 12:
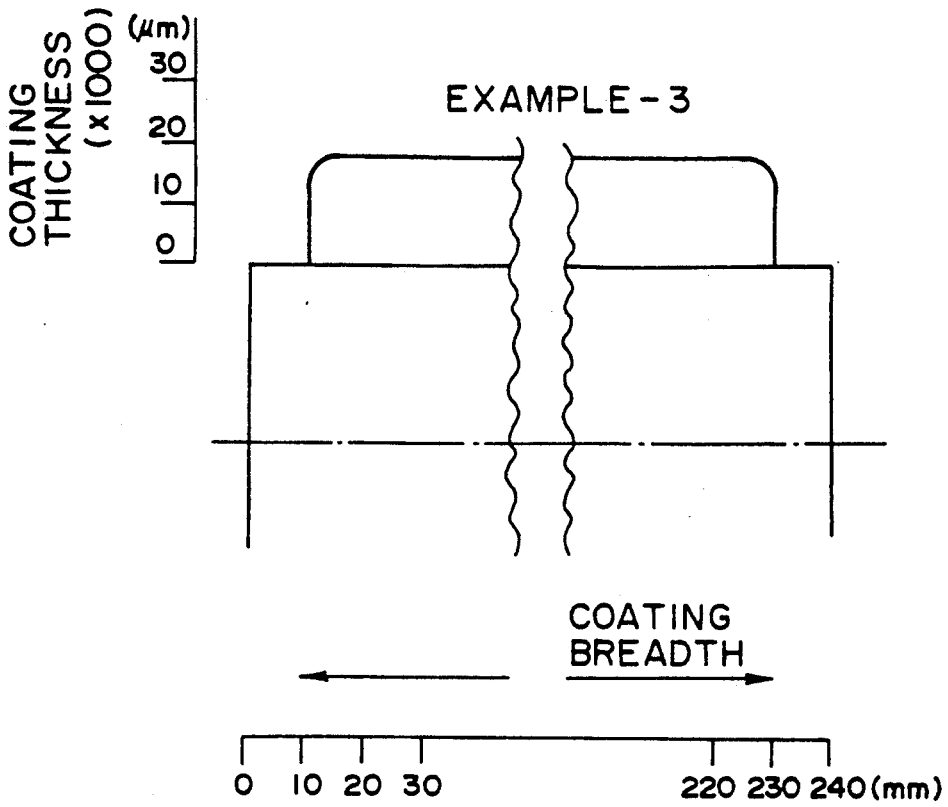
Figure 13:
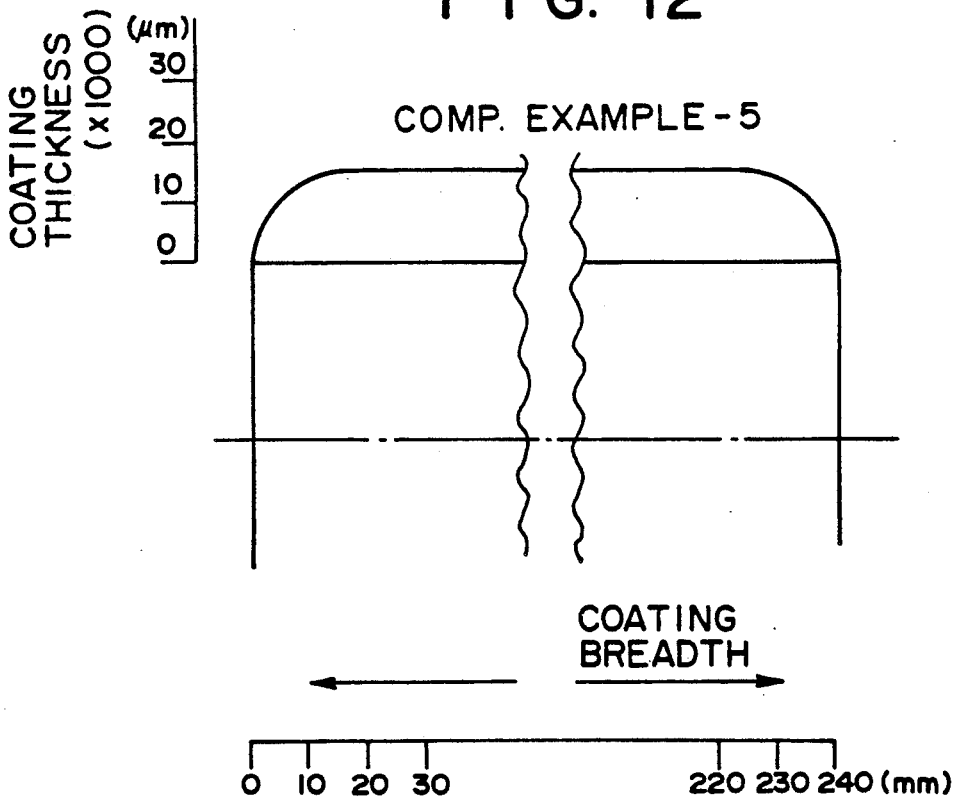

More specifically, FIG. 10 shows a relationship between the percentage utilization of the paint and the discharge velocity; FIG. 11 shows a relationship between the surface roughness of the coating film and the discharge velocity; FIG. 12 is a schematic view illustrating the thickness distribution of the coating film of Example 3, FIG. 13 is a schematic view illustrating the thickness distribution of the coating film of Comparative Example 5.

As the discharge velocity was increased from 5.0 m/sec to 100 m/sec, the average coating film thickness was decreased from 18 to 10 microns and the percentage paint utilization was decreased from 100% to 50% as shown in FIG. 10.

The surface roughness of the coating film also increased from 0.1 to 0.48 micron as shown in FIG. 11 as the discharge velocity was increased from 5.0 m/sec. to 100 m/sec.

The standard deviation of the film thickness also increased from 0.2 to 1.0 micron as the discharge velocity increased from 5 m/sec. to 100 m/sec.

Further, the number of bubbles in the coating film were 5, 10 and 20 per 100 cm$^2$, thus increased in the order of Comparative Examples 5, 6 and 7. Particularly, as shown in FIGS. 12 and 13 showing the coating thickness distribution, an excellent controllability of the coating film formation was achieved from the coating breadth of from 10 mm to 230 mm, outside which substantially no attachment of the paint occurred in Example 3.

On the other hand, in Comparative Examples operated at large discharge angles, the paint was also attached to outside the coating breadth region, thus resulting in a remarkable coating thickness charge in the breadth range of from 0 mm to 240 mm. Accordingly, in each Comparative Example, masking or post-peeling of the excessively coated paint was necessary at both ends of the cylinder in order to control the coating breadth, thus requiring a complicated procedure for the coating.

EXAMPLE 6

1.0 part of alcohol-soluble nylon-6 resin (Mn $=5\times10^4$) was dissolved in 99 parts of n-butyl alcohol to form a paint for providing a primer layer having a viscosity of 4.5 cps.

The paint was pressurized to a discharge pressure of 1.0 kg.f/cm$^2$ and discharged through a nozzle tip having a single discharge port with an aperture diameter of 90 microns at a discharge velocity of 10.6 m/sec and a rate of 3.8 cc/min in the form of not a spray but a string by using a coating apparatus as shown in FIG. 4A, whereby an aluminum cylinder having a diameter of 60 mm and a length of 240 mm was coated with the discharged paint with respect to its longitudinal portion ranging from 10 mm to 230 mm (coating breadth of 220 mm). In the coating operation, the cylinder was rotated at a speed of 100 rpm, and the discharge port was moved laterally at a rate of 200 mm/min (a coating pitch of 2 mm) relative to and with a spacing of 30 mm from the aluminum cylinder.

After the coating, the coated cylinder was dried at 100° C. for 10 minutes to form a coating film (primer layer) having an average thickness of 1.1 micron.

Separately, 0.7 part of ε-type copper-phthalocyanine as a charge-generation substance was dispersed in a mixture of 0.3 part of butyl aldehyde-modified vinyl acetate resin (Mn$=10\times10^4$) and 99 parts of cyclohexanone to form a paint for a charge-generation layer having a viscosity of 5.0 eps, wherein the copper-phthalocyanine was dispersed in a number-average particle size of 5.0 cps.

The paint was discharged through a nozzle tip having a single discharge port with an aperture diameter of 70 microns at a discharge pressure of 0.5 kg.f/cm$^2$, a discharge velocity of 5.0 m/sec and a rate of 1.2 cc/min in the form of not a spray but a string by using a coating apparatus as shown in FIG. 4A, whereby the above-coated aluminum cylinder was further coated with the discharged paint in its lengthwise range of 10 mm to 230 mm. In the coating operation, the cylinder was rotated at a speed of 100 rpm, and the discharge port was moved laterally at a rate of 200 mm/min relative to and with a spacing of 30 mm from the cylinder.

After the coating, the coated cylinder was dried at 100° C. for 10 minutes to form a coating film (charge generation layer) having an average thickness of 0.3 micron.

Further, 5 parts of benzaldehyde-4-(diethylamino)-1-naphthylethylphenyl-hydrazone and 5 parts of styrene-naphthyl-methacrylate copolymer (Mn=10×10$^4$) were dissolved in 90 parts of monochlorobenzene to form a paint for a charge transport layer having a viscosity of 20 cps.

The paint was discharged through a nozzle tip having a single discharge port with an aperture diameter of 120 m at a discharge pressure of 1.0 kg.f/cm$^2$, a discharge velocity of 0.6 m/sec. and a rate of 7.2 cc/min. in the form of not a spray but a string by using a coating apparatus as shown in FIG. 4A, whereby the above-coated aluminum cylinder was further coated with the discharged paint in its lengthwise range of 10 mm to 230 mm. In the coating operation, the cylinder was rotated at a speed of 100 rpm, and the discharge port was moved laterally at a rate of 200 mm/min. relative to and with a spacing of 30 mm from the cylinder.

After the coating, the coated cylinder was dried at 100° C. for 60 minutes to form a coating film (charge transport layer) having an average thickness of 19 microns, whereby a photosensitive member for electrophotography was prepared.

COMPARATIVE EXAMPLE 8

A photosensitive member was prepared in a similar manner as in Example 6 except that the discharge angle was set to 40 degrees as in Comparative Example 3 and the paints used in Example 6 were discharged under conditions modified as shown in the following Table 3 so as to provide the respective coating films in the same thicknesses as in Example 6.

TABLE 3

| | Primer layer (alcohol-soluble nylon-6) | Charge generation layer (Cu-phthalocyanine) | Charge transport layer (hydrazone compound) |
|---|---|---|---|
| Discharge port diameter | 96 μm | 75 μm | 130 μm |
| Discharge pressure | 1.0 kg · f/cm$^2$ | 0.5 kg · f/cm$^2$ | 1.0 kg · f/cm$^2$ |
| Discharge velocity | 10.6 m/sec | 5.0 m/sec | 10.6 m/sec |
| Discharge rate | 4.3 cc/min. | 1.4 cc/min. | 8.2 cc/min. |
| Paint utilization | 88% | 88% | 88% |

COMPARATIVE EXAMPLE 9

A photosensitive member was prepared in a similar manner as in Example 6 except that a larger discharge of 1.5 kg.f/cm$^2$ was adopted, the discharge angle was set to 15 degrees and the paints used in Example 6 were discharged under conditions modified as shown in the following Table 4 so as to provide the respective coating films in the same thicknesses as in Example 6.

TABLE 4

| | Primer layer (alcohol-soluble nylon-6) | Charge generation layer (Cu-phthalocyanine) | Charge transport layer (hydrazone compound) |
|---|---|---|---|
| Discharge port diameter | 40 μm | 22 μm | 54 μm |
| Discharge pressure | 10 kg · f/cm$^2$ | 10 kg · f/cm$^2$ | 10 kg · f/cm$^2$ |
| Discharge velocity | 100 m/sec | 100 m/sec | 100 m/sec |
| Discharge rate | 7.6 cc/min. | 2.4 cc/min. | 14.4 cc/min. |
| Paint utilization | 50% | 50% | 50% |

COMPARATIVE EXAMPLE 10

A photosensitive member was prepared in a similar manner as in Example 6 except that an air spraying method was applied by using the apparatus used in Example 6 and the paints used in Example 6 were discharged under conditions modified as shown in the following Table 5 so as to provide the respective coating films in the same thicknesses as in Example 6.

TABLE 5

| | Primer layer (alcohol-soluble nylon-6) | Charge generation layer (Cu-phthalocyanine) | Charge transport layer (hydrazone compound) |
|---|---|---|---|
| Discharge angle | 60° | 60° | 60° |
| Discharge air pressure | 2.0 kg | 2.0 kg | 2.0 kg |
| Pattern-control air pressure | 3.5 kg | 3.5 kg | 3.5 kg |
| Discharge rate | 19 cc/min. | 6 cc/min. | 36 cc/min. |
| Paint utilization | 20% | 20% | 20% |

COMPARATIVE EXAMPLE 11

A photosensitive member was prepared in a similar manner as in Example 6 except that an airless spraying method was applied by using the apparatus used in Example 6 and the paints used in Example 6 were discharged under conditions modified as shown in the following Table 6 so as to provide the respective coating films in the same thicknesses as in Example 6.

TABLE 6

| | Primer layer (alcohol-soluble nylon-6) | Charge generation layer (Cu-phthalocyanine) | Charge transport layer (hydrazone compound) |
|---|---|---|---|
| Discharge angle | 60° | 60° | 60° |
| Discharge port diameter | 32 μm | 20 μm | 44 μm |

TABLE 6-continued

| | Primer layer (alcohol-soluble nylon-6) | Charge generation layer (Cu-phthalocyanine) | Charge transport layer (hydrazone compound) |
|---|---|---|---|
| Discharge pressure | 50 kg · f/cm$^2$ | 50 kg · f/cm$^2$ | 50 kg · f/cm$^2$ |
| Discharge velocity | 200 m/sec | 200 m/sec | 200 m/sec |
| Discharge rate | 9.5 cc/min | 3 cc/min | 18 cc/min |
| Paint utilization | 40% | 40% | 40% |

The coating performances for the respective layers of the above Example 6 and Comparative Examples 8–11 are shown in the following Table.

TABLE 7

| | Primer layer (alcohol-soluble nylon-6) | | Charge generation layer (Cu-phthalocyanine) | | Charge transport layer (hydrazone compound) | |
|---|---|---|---|---|---|---|
| | Surface roughness (μm) | Standard deviation of thickness (μm) | Surface roughness (μm) | Standard deviation of thickness (μm) | Surface roughness (μm) | Standard deviation of thickness (μm) |
| Example 6 | 0.1 | 0.1 | 0.1 | 0.03 | 0.2 | 0.2 |
| Comp. Example 8 | 0.25 | 0.2 | 0.25 | 0.05 | 0.5 | 0.7 |
| Comp. Example 9 | 0.3 | 0.3 | 0.3 | 0.07 | 0.5 | 1.0 |
| Comp. Example 10 | 0.4 | 0.35 | 0.4 | 0.07 | 0.8 | 0.8 |
| Comp. Example 11 | 0.3 | 0.3 | 0.3 | 0.07 | 0.6 | 1.0 |

Each of the above photosensitive members was evaluated with respect to its electrophotographic performances. More specifically, each photosensitive member was assembled in a laser beam printer of the reversal development-type provided with an aluminum/gallium-/arsenic ternary-semiconductor laser (power: 5 mW) under the conditions of surface charge control potential at primary charging: −700 V, image exposure quantity: 9.5 μJ/cm$^2$, transfer potential: +700 V, developer polarity: negative, process speed: 50 mm/sec, development condition (development bias voltage): −450 V, image scanning system, and exposure before primary charging: whole-area exposure to 50 lux.sec of red light.

The results are summarized in the following Table.

TABLE 8

| | Surface potential at primary charging (-V) | Surface potential after image exposure (-V) | Number of image defects (black dots) (-/100 cm$^2$) |
|---|---|---|---|
| Example 6 | 700 | 150 | 0 |
| Comparative Example 8 | 700–650 | 150–130 | 5 |
| Comparative Example 9 | 700–650 | 150–130 | 5 |
| Comparative Example 10 | 700–600 | 150–110 | 10 |
| Comparative Example 11 | 700–650 | 150–130 | 5 |

As shown in the above Tables 7 and 8, the photosensitive member of Example 6 provided a very small standard deviation of film thickness for the respective layers and a very excellent uniformity in surface potential at the time of primary charging The surface roughness thereof was much smaller than those of Comparative Examples, so that no image defects (black dots or spots formed on an expected white background due to defects of the photosensitive member) were observed at all.

The above results show that the electrophotographic photosensitive member prepared according to the present invention is very excellent in uniformity and few image defects.

EXAMPLE 7

10 parts of phenolic resin (trade name: Plyophen J-325, mfd. by Dai Nippon Ink K. K.), 11 parts of titanium oxide surface-treated with tin oxide and antimony oxide, 11 parts of titanium oxide surface-treated with alumina, 4 parts of methanol and 9 parts of methyl cellosolve were dispersed for 2 hours together with the same amount of 1 mm-diameter hard glass-beads in a sand mill disperser. The dispersed mixture was diluted with a 1:1 mixture solvent of methanol and methyl cellosolve so as to provide a solid content of 35%, whereby a paint for a conductive layer having a viscosity of 15 cps was prepared.

The paint was charged in a tank and placed under an air pressure of 1 kg.f/cm$^2$ to be discharged through a beam gun provided with a nozzle tips having an aperture diameter, whereby the paint was discharged at a rate of 5 cc/min and a velocity of 10.6 m/sec.

Then, the beam gum was held at 20 mm spaced from an aluminum cylinder having a diameter of 80 mm and a length of 360 mm and rotated at 100 rpm and then moved at a rate of 170 mm/min rative to the cylinder, thereby to discharge the paint in the form of not a spray but a string onto the cylinder where the paint was attached to form a paint lines wound about the cylinder like a thread on a spool at a pitch of about 2 mm. Then, the paint lines were started to be leveled to form a film of a smooth surface having a roughness of 0.2 micron or less after 5 minutes, thus being free of coating pitch irregularity. Then, the solvent was evaporated from the paint film by forcive exhaustion, followed by curing at −140° C. in a drying oven for 30 minutes. Then, the coated aluminum cylinder was cooled to room temperature to form a 20 micron-thick electroconductive film.

Separately, 1 part of polyamide resin (trade name: Amilan CM-8000, mfd. by Toray K. K.) and 3 parts of modified polyamide resin (methoxymethyl-modified nylon-6; trade name: Toresin, mfd. by Teikoku Kagaku K. K.) were dissolved in a mixture solvent of 130 parts of methanol and 66 parts of 1-butanol to prepare a paint for a primer layer having a viscosity of 10 cps.

The primer paint was charged in a tank, pressurized to 0.6 kg.f and discharged through a gun having a nozzle tip with an aperture diameter of 100 microns, whereby the paint was discharged at a rate of 3 cc/min. and a velocity of 10.6 m/sec. The gun was held at 20 mm from the above-coated cylinder rotating at 120 rpm and moved at a feed rate of 250 mm/min, so that the paint was discharged in the form of not a spray but a string to form primer paint lines at a pitch of about 2 mm on the conductive layer. Then, the attached paint lines were spontaneously leveled to form a film of a smooth surface with a surface roughness of 0.1 micron to remove the paint pitch ununiformity after 5 minutes. Then, the coated cylinder was subjected to evaporation of the solvent under forcive exhaustion, dried at 90° C. in an oven for 10 minutes and then cooled to room temperature to form a 0.5 micron-thick primer layer.

Further, 10 parts of vinyl acetate-vinyl alcohol-vinyl benzol copolymer was dissolved in 90 parts of cyclohexanone, and to the resultant solution, 25 parts as solid of a disazo pigment (2-[4'-{3-(2-chlorophenyl)carbamoyl-2-hydroxy-1-naphthylazo}benzoxazole, 300 parts of cyclohexanone and 250 parts of tetrahydrofuran were added. The resultant mixture was dispersed together with the same volume of 1 mm-diameter hard glass beads in a sand mill at 900 rpm for 40 hours, followed by separation from the beads and diluted with cyclohexane to provide a solid content of 0.5%, whereby a paint for charge generation layer having a viscosity of 10 cps was prepared.

The charge-generation paint was charged in a tank, pressurized to 0.5 kg.f and discharged through a gun having a nozzle tip with an aperture diameter of 75 microns, whereby the paint was discharged at a rate of 1.1 cc/min and a velocity of 10.6 m/sec. The gun was held at 10 mm from the above-coated cylinder rotating at 60 rpm and moved at a feed rate of 100 mm/min in the longitudinal direction of the cylinder, so that the paint was discharged in the form of not a spray but a string to form paint lines at a pitch of about 1.5 mm on the primer layer. Then, the attached paint lines were spontaneously leveled to form a film of a smooth surface with a surface roughness of 0.1 micron to remove the paint pitch ununiformity after 5 minutes. Then, the coated cylinder was subjected to evaporation of the solvent under forcive exhaustion, dried at 90° C. in an oven for 5 minutes and then cooled to room temperature to form a 0.15 micron-thick charge-generation layer.

Further, 10 parts of polycabonate resin (trade name: Z-200, mfd. by Mitsubishi Gas Kagaku K. K.) and 9.5 parts of a hydrazone compound (p-(N,N-diethylamino)-benzaldehyde-N'-α-naphthyl-N'-phenylhydrazone) were dissolved in a mixture of 100 parts of monochlorobenzene and 40 parts of dichloromethane to prepare a paint for a charge-transport layer having a viscosity of 15 cps.

The charge-transport paint was charged in a tank, pressurized to 0.6 kg.f and discharged through a gun having a nozzle tip with an aperture diameter of 150 microns, whereby the paint was discharged at a rate of 12.5 cc/min and a velocity of 10.6 m/sec. The gun was held at 20 mm from the above-coated cylinder rotating at 120 rpm and moved at a feed rate of 200 mm/min, so that the paint was discharged in the form of not a spray but a string to form point lines at a pitch of about 2 mm on the charge-generation layer. Then, the attached paint lines were spontaneously leveled to form a film of a smooth surface with a surface roughness of 0.2 micron or less to remove the paint pitch uniniformity after 5 minutes. Then, the coated cylinder was subjected to evaporation of the solvent under forcive exhaustion, dried at 120° C. in an oven for 60 minutes and then cooled to room temperature to form a 20 micron-thick charge-transport layer.

The thus prepared OPC photosensitive member was assembled in an electrophotographic copying machine and subjected to a successive image formation test of 100,000 sheets, whereby an image of high quality was continually obtained until the end.

What is claimed is:

1. A process for producing a photosensitive member for electrophotography, comprising:

discharging a paint for providing a photosensitive member through an aperture onto a cylindrical substrate to coat the substrate with the discharged paint, wherein the paint is discharged from the aperture in the form of a continuous string substantially free from spraying.

2. A process according to claim 1, wherein said paint for providing a photosensitive member comprises a paint for providing a photosensitive layer.

3. A process according to claim 2, wherein said paint for providing a photosensitive layer comprises a paint for providing a charge-transport layer.

4. A process according to claim 3, wherein said paint for providing a charge-transport layer comprises a solution of a charge-transport substance and a binder resin dissolved in an organic solvent.

5. A process according to claim 2, wherein said paint for providing a photosensitive layer comprises a paint for providing a charge-generation layer.

6. A process according to claim 5, wherein said paint for providing a charge-generation layer comprises a dispersion of a charge-generation substance in an organic solvent containing a binder resin.

7. A process according to claim 1, wherein said paint for providing a photosensitive member comprises a paint for providing an intermediate layer.

8. A process according to claim 7, wherein said paint for providing an intermediate layer comprises a paint for providing a primer layer.

9. A process according to claim 8, wherein said paint for providing a primer layer comprises a solution of a resin in an organic solvent.

10. A process according to claim 7, wherein said paint for providing an intermediate layer comprises a paint for providing an electroconductive layer.

11. A process according to claim 10, wherein said paint for providing an electroconductive layer comprises a dispersion of electroconductive particles in an organic solvent containing a binder resin.

12. A process according to claim 1, wherein the paint discharged from the aperture forms a discharge angle in the range of 3–0 degrees.

13. A process according to claim 1, wherein the paint has a viscosity of 1000 cps or below.

14. A process according to claim 13, wherein the paint has a viscosity of 200 cps or below.

15. A process according to claim 1, wherein the aperture is disposed 2–100 mm spaced apart from the substrate.

16. A process according to claim 15, wherein the aperture is disposed 5–50 mm spaced apart from the substrate.

17. A process according to claim 1, wherein the paint is discharged at a velocity of 30 m/sec or below.

18. A process according to claim 1, wherein the aperture has a diameter of 200 microns or smaller.

19. A process according to claim 1, wherein the paint is discharged at a discharge pressure of 3 kg.f/cm$^2$ or below.

20. A process according to claim 1, wherein the paint is discharged at a rate of 20 cc/min or less.

21. A process according to claim 1, wherein the paint is discharged through two or more of the apertures.

22. A process according to claim 1, wherein the aperture is moved in parallel with the rotation axis of the cylindrical substrate.

23. A process according to claim 1, wherein the discharged paint is spirally wound about the cylindrical substrate.

24. A process for producing a photosensitive member for electrophotography, comprising:

discharging a paint for providing a photosensitive member through an aperture in the form of a continuous string substantially free from spraying to attach the paint onto a cylindrical substrate, and leveling the attached paint to form a coating film on the substrate.

25. A process according to claim 24, wherein the aperture is moved in parallel with the rotation axis of the cylindrical substrate.

26. A process according to claim 24, wherein the discharged paint is spirally wound about the cylindrical substrate.

* * * * *